US010882320B2

(12) United States Patent
Takehana

(10) Patent No.: US 10,882,320 B2
(45) Date of Patent: Jan. 5, 2021

(54) INKJET RECORDING APPARATUS AND CLEANING METHOD

(71) Applicant: KYOCERA Document Solutions Inc., Osaka (JP)

(72) Inventor: Hiroki Takehana, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/597,537

(22) Filed: Oct. 9, 2019

(65) Prior Publication Data

US 2020/0114648 A1 Apr. 16, 2020

(30) Foreign Application Priority Data

Oct. 10, 2018 (JP) ..... 2018-191673

(51) Int. Cl.
*B41J 2/165* (2006.01)
*B41J 2/045* (2006.01)
*B41J 29/393* (2006.01)

(52) U.S. Cl.
CPC ..... *B41J 2/16579* (2013.01); *B41J 2/04581* (2013.01); *B41J 2/1652* (2013.01); *B41J 29/393* (2013.01); *B41J 2002/1657* (2013.01); *B41J 2002/16573* (2013.01); *B41J 2029/3935* (2013.01)

(58) Field of Classification Search
CPC ..... B41J 2/1652; B41J 2002/1657; B41J 2002/16573; B41J 2/16517
See application file for complete search history.

(56) References Cited

U.S. PATENT DOCUMENTS 7,517,044 B2 * 4/2009 Suzuki ..... B41J 2/16526 347/22
8,567,896 B2 10/2013 Ueshima
2012/0050377 A1 3/2012 Ueshima

FOREIGN PATENT DOCUMENTS

JP 2012-045831 A 3/2012

* cited by examiner

*Primary Examiner* — Julian D Huffman
(74) *Attorney, Agent, or Firm* — Studebaker & Brackett PC

(57) ABSTRACT

An inkjet recording apparatus allows for cleaning. The inkjet recording apparatus includes an image forming section and a controller. The image forming section has a plurality of nozzles and forms an image on a recording medium by ejecting ink from the nozzles. The controller controls the image forming section. The nozzles eject the ink during the cleaning. The controller includes a determining section, and an adjusting section. The determining section determines whether or not the ink has been ejected from the nozzles. The adjusting section adjusts an ejection amount of the ink in a stepwise manner based on a determination result by the determining section.

5 Claims, 9 Drawing Sheets

T

| Level | 1 | 2 | 3 | 4 | 5 |
|---|---|---|---|---|---|
| Ejection amount of ink | 0 mL | 1 mL | 2 mL | 6 mL | 6 mL |
| Number of times of ejection | 1 | 1 | 1 | 1 | 2 |

FIG. 6

INKJET RECORDING APPARATUS AND CLEANING METHOD

INCORPORATION BY REFERENCE

The present application claims priority under 35 U.S.C. § 119 to Japanese Patent Application No. 2018-191673, filed on Oct. 10, 2018. The contents of this application are incorporated herein by reference in their entirety.

BACKGROUND

The present disclosure relates to an inkjet recording apparatus and a cleaning method.

In general, an inkjet recording apparatus is known which can perform maintenance of a recording head. The inkjet recording apparatus performs cleaning of the recording head. Cleaning is an operation through which ink is forcefully ejected from a nozzle which is clogged by congealed ink and is non-ejecting. By forcefully ejecting the ink from the nozzle, non-ejection of the nozzle is resolved. According to the inkjet recording apparatus, non-ejection of a nozzle of the recording head can be resolved.

SUMMARY

An inkjet recording apparatus according to an aspect of the present disclosure allows for cleaning. The inkjet recording apparatus includes an image forming section and a controller. The image forming section has a plurality of nozzles and forms an image on a recording medium by ejecting ink from the nozzles. The controller controls the image forming section. The nozzles eject the ink during the cleaning. The controller includes a determining section, and an adjusting section. The determining section determines whether or not the ink has been ejected from the nozzles. The adjusting section adjusts an ejection amount of the ink in a stepwise manner based on a determination result by the determining section.

A cleaning method according to an aspect of the present disclosure is to be implemented by an inkjet recording apparatus. The cleaning method includes forming an image, controlling ejection, ejecting ink, determining, and adjusting. In the forming of the image, the image is formed on a recording medium by ejecting the ink from a plurality of nozzles. In the controlling of the ejection, the ejection of the ink is controlled. In the ejecting of the ink, the nozzles eject the ink during cleaning. In the determining, it is determined whether or not the ink has been ejected from the nozzles. In the adjusting, an ejection amount of the ink is adjusted in a stepwise manner based on a determination result of whether or not the ink has been ejected.

BRIEF DESCRIPTION OF THE DRAWINGS

FIG. 6 is a diagram illustrating ejection amount data of ink ejected by cleaning.

DETAILED DESCRIPTION

Figure 1:
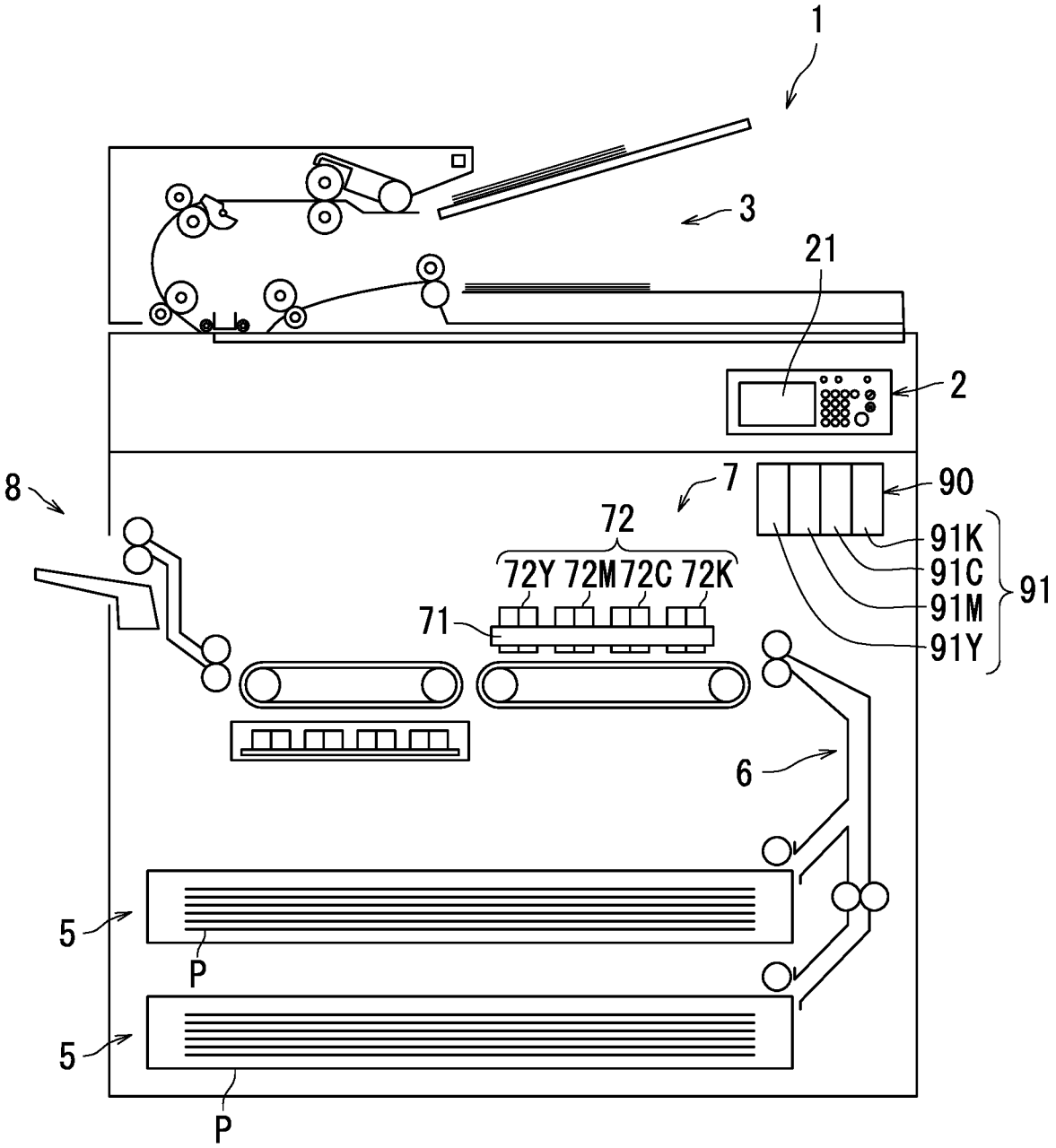
FIG. 1 is a diagram illustrating a configuration of an inkjet recording apparatus according to an embodiment of the present disclosure.

The following describes an embodiment of the present disclosure with reference to the accompanying drawings. Elements that are the same or equivalent are labelled with the same reference signs in the drawings and description thereof is not repeated.

First, a configuration of an inkjet recording apparatus 1 is described with reference to FIG. 1. FIG. 1 is a diagram illustrating the configuration of the inkjet recording apparatus 1 according to the embodiment of the present disclosure.

As illustrated in FIG. 1, the inkjet recording apparatus 1 includes an operation panel 2, a reading section 3, a paper feeding unit 5, a conveyance unit 6, an image forming section 7, an ink supplying device 90, and an ejection device 8.

The operation panel 2 receives a job instruction from a user for the inkjet recording apparatus 1. The operation panel 2 includes an information section 21 and a plurality of operation keys.

The information section 21 communicates information to the user. Examples of the information section 21 include a liquid-crystal display and an organic electroluminescent (EL) display.

The reading section 3 reads an image formed on a recording medium P. The reading section 3 is a scanner for acquiring image data from the recording medium P.

The paper feeding unit 5 houses the recording medium P. The recording medium P fed from the paper feeding unit 5 is conveyed to the conveyance unit 6.

The conveyance unit 6 conveys the recording medium P so as to pass beneath the image forming section 7. Also, after the recording medium P has passed beneath the image forming section 7, the conveyance unit 6 conveys the recording medium P to the ejection device 8.

The image forming section 7 forms an image on the recording medium P by ejecting ink. The image forming section 7 includes a head housing 71 and four lineheads 72. The head housing 71 supports the four lineheads 72.

The ink supplying device 90 supplies ink to the image forming section 7. The ink supplying device 90 includes an ink tank 91. The ink tank 91 houses ink. The ink in the ink tank 91 includes ink to be ejected to record an image and ink to be ejected to clean the image forming section 7. The ink tank 91 is provided for each ink color. Specifically, the ink tank 91 is provided as an ink tank 91Y which stores yellow ink, an ink tank 91M which stores magenta ink, an ink tank 91C which stores cyan ink, and an ink tank 91K which stores black ink.

The ejection device 8 ejects the recording medium P out of the inkjet recording apparatus 1. The ejection device 8 includes an exit tray. After being ejected out of the inkjet recording apparatus 1, the recording medium P is placed on the exit tray.

Figure 2:
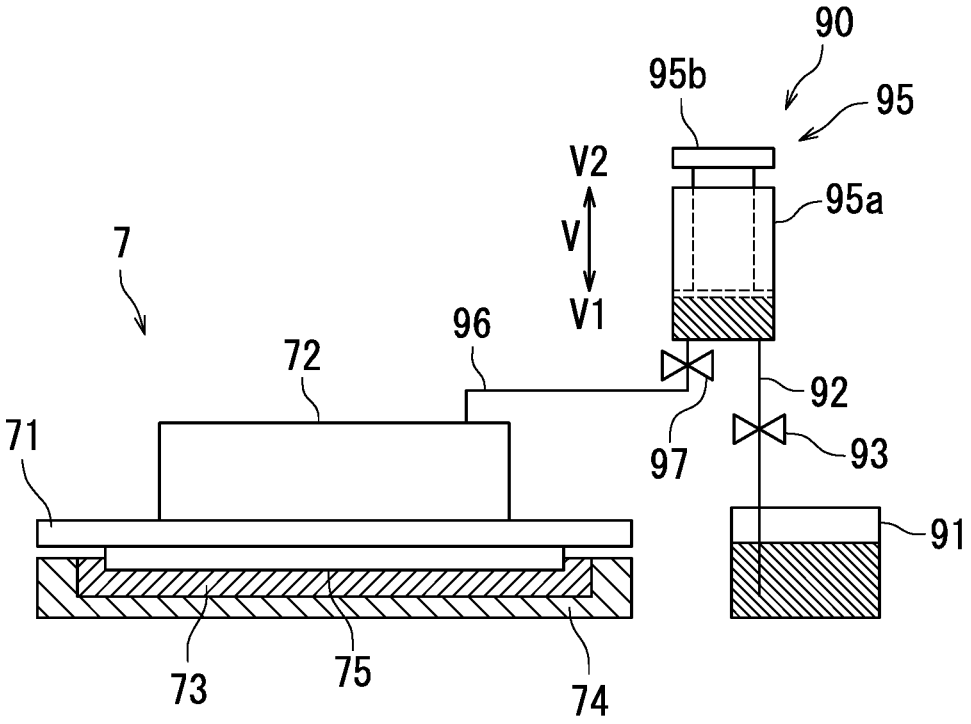
FIG. 2 is a diagram illustrating a linehead and an ink supplying device according to the embodiment of the present disclosure.

Next, the ink supplying device 90 is described in detail with reference to FIGS. 1 and 2. FIG. 2 is a diagram illustrating a linehead 72 and the ink supplying device 90. In addition to the ink tank 91 as illustrated in FIG. 2, the ink supplying device 90 includes a syringe pump 95, a first pipe 92, a second pipe 96, a first solenoid valve 93, and a second solenoid valve 97 for each ink color.

The syringe pump 95 delivers corresponding ink. The syringe pump 95 delivers a prescribed amount of ink. The syringe pump 95 has a cylinder 95*a* and a piston 95*b*. The syringe pump 95 is connected to the linehead 72 of the same color through a corresponding second pipe 96.

The cylinder 95*a* stores ink. The cylinder 95*a* includes a cylindrical portion and a base portion. An inlet port and an outlet port are formed in the base portion of the cylinder 95*a*.

The piston 95*b* moves inside the cylinder 95*a*. The piston 95*b* is cylindrical. A portion of the piston 95*b* is inserted into the cylinder 95*a*. The piston 95*b* moves in a direction V. The direction V is a vertical direction. The direction V includes a direction V1 and a direction V2. The direction V1 is downward. The direction V2 is upward.

When the piston 95*b* moves in the direction V2, ink flows from the ink tank 91 into the cylinder 95*a* through the first pipe 92 and the inlet port. When the piston 95*b* moves in the direction V1, ink flows from the cylinder 95*a* out to the image forming section 7 through the outlet port and the second pipe 96.

The first pipe 92 connects the ink tank 91 to the syringe pump 95. The second pipe 96 connects the syringe pump 95 to the image forming section 7. The first solenoid valve 93 is located in the first pipe 92. The second solenoid valve 97 is located in the second pipe 96.

The first solenoid valve 93 controls the inflow and outflow of ink by opening and closing. Specifically, the first solenoid valve 93 is opened just before the piston 95*b* starts moving in the direction V2, and is closed just after the piston 95*b* stops moving in the direction V2.

The second solenoid valve 97 controls the inflow and outflow of ink by opening and closing. Specifically, the second solenoid valve 97 is opened just before the piston 95*b* starts moving in the direction V1, and is closed just after the piston 95*b* stops moving in the direction V1.

As illustrated in FIG. 2, the image forming section 7 further includes a pad portion 73, a holding portion 74, and a cleaning blade (unillustrated) in addition to the head housing 71 and the linehead 72.

The pad portion 73 covers the linehead 72. The pad portion 73 is made of porous material. The porous material is a continuous foam body, for example. The porous material has a porous structure inside. Because the porous material has a porous structure inside, the porous material can absorb liquid. A cleaning liquid permeates the porous material. The cleaning liquid can dissolve congealed ink. The pad portion 73 removes adhered ink from the linehead 72 by making contact with the linehead 72.

The holding portion 74 holds the pad portion 73.

The cleaning blade wipes adhered ink off of the linehead 72. Specifically, the cleaning blade brings the pad portion 73 into contact with the linehead 72 and wipes ink dissolved by the cleaning liquid off of the linehead 72. As a result, ink can be prevented from adhering to the linehead 72.

Figure 3:
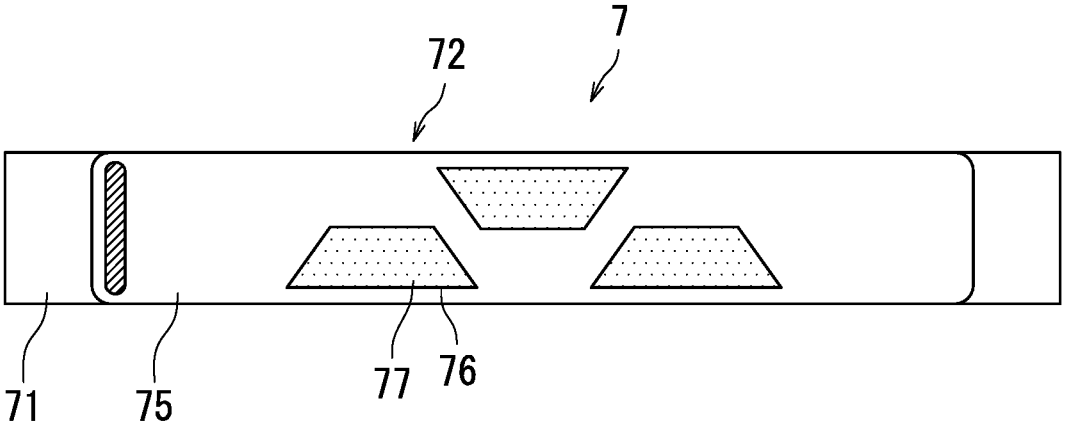
FIG. 3 is a diagram illustrating a lower surface of the linehead.

Next, the linehead 72 is described in detail with reference to FIGS. 1 to 3. FIG. 3 is a diagram illustrating a lower surface 75 of the linehead 72.

The image forming section 7 further includes a plurality of ejection portions 76. The ejection portions 76 are located on the lower surface 75 of the linehead 72. The ejection portions 76 are staggered in relation to each other.

The image forming section 7 further includes a plurality of nozzles 77. Specifically, each ejection portion 76 of the image forming section 7 includes a plurality of nozzles 77. The nozzles 77 are located on the ejection portions 76. The nozzles 77 each eject ink toward the recording medium P. That is, the image forming section 7 forms an image on the recording medium P by ejecting ink from the nozzles 77. Specifically, the nozzles 77 each eject ink toward a droplet attachment position set on the recording medium P by a controller 10. Also, the nozzles 77 each eject ink during cleaning.

For example, an ink ejection method such as a piezoelectric method can be applied in each of the nozzles 77. Through the piezoelectric method, ink is ejected using a piezoelectric element. In detail, in the piezoelectric method, a pulse of a prescribed waveform is input to the piezoelectric element and the piezoelectric element deforms in response to the pulse. As a result, pressure from the deformation of the piezoelectric element is applied to ink inside the nozzle 77 and the ink vibrates. As a result, the ink is ejected from the nozzle 77.

Figure 4:
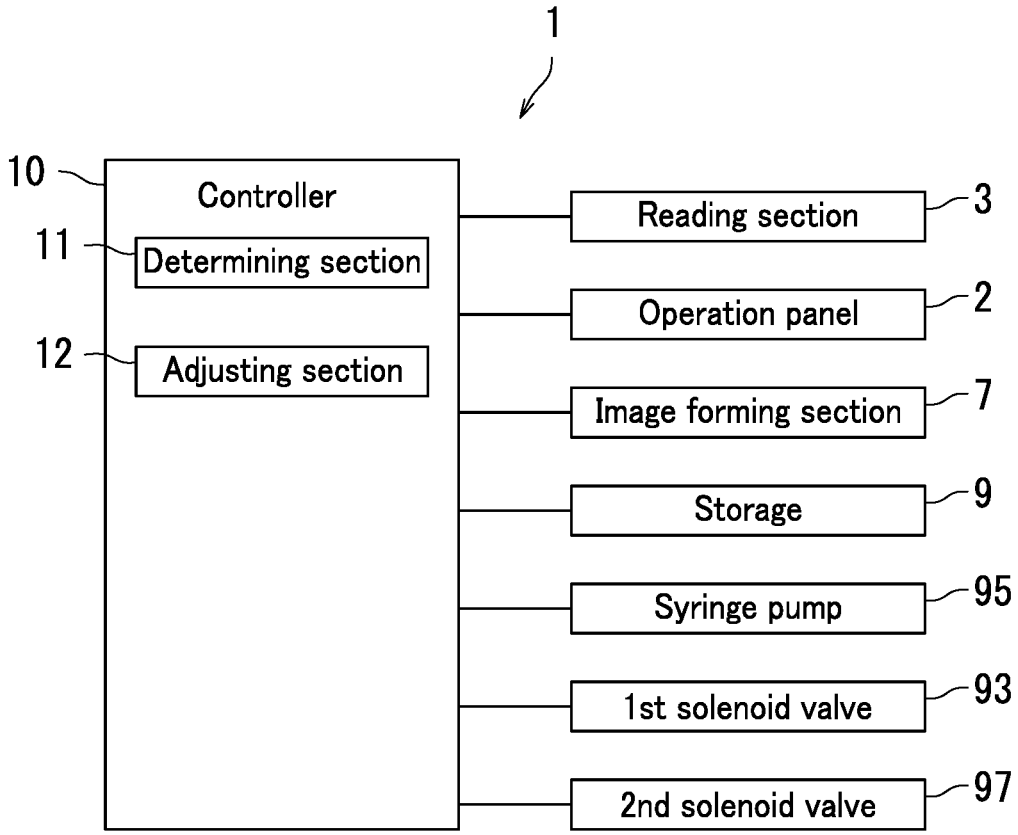
FIG. 4 is a block diagram illustrating a controller of the inkjet recording apparatus.

Next, the controller 10 is described with reference to FIGS. 1 to 4. FIG. 4 is a block diagram illustrating the controller 10 of the inkjet recording apparatus 1.

The inkjet recording apparatus 1 further includes storage 9 and the controller 10.

The storage 9 stores data therein. The storage 9 is composed of a storage apparatus such as a storage device and semiconductor memory. The storage device is composed of either or both of a hard disk drive (HDD) and a solid-state drive (SSD), for example. The semiconductor memory is composed of random-access memory (RAM) and read-only memory (ROM), for example. The data includes cleaning information. The cleaning information includes a cleaning completion time, the positions of the nozzles 77, the number of the nozzles 77, and an ejection amount of ink. The storage 9 stores a control program therein.

The storage 9 stores ejection amount data therein. The ejection amount data includes data indicating an amount of ink ejected per pixel and data indicating an amount of ink ejected by cleaning.

The storage 9 stores therein an amount of ink ejected by recording an image and an amount of ink ejected by cleaning.

The controller 10 is composed of a processor such as a central processing unit (CPU). The controller 10 controls operation of each section of the inkjet recording apparatus 1 by executing the control program. The controller 10 includes an integrated circuit for an image forming process. The integrated circuit for the image forming process is composed of an application specific integrated circuit (ASIC), for example. The controller 10 is connected to the reading section 3, the information section 21, the image forming section 7, the storage 9, the syringe pumps 95, the first solenoid valves 93, and the second solenoid valves 97.

The controller 10 includes a determining section 11 and an adjusting section 12. The controller 10 functions as the determining section 11 and the adjusting section 12 by executing the control program.

The determining section 11 determines whether or not ink has been ejected from the nozzles 77. Specifically, the determining section 11 determines, for each nozzle 77, whether or not ink has been ejected from the nozzle 77 after cleaning. Because the determining section 11 determines whether or not ink has been ejected from the nozzles 77 after cleaning, the result of cleaning can be determined.

The cleaning includes first cleaning and second cleaning. The determining section 11 determines, for each nozzle 77, whether or not ink has been ejected from the nozzle 77 after the first cleaning. The determining section 11 determines whether or not a prescribed period has elapsed between the end of the first cleaning and the performance of the second cleaning. The prescribed period is "ten minutes". The first cleaning is performed before the second cleaning. The second cleaning is cleaning performed after the first cleaning. Specifically, when the operation panel 2 receives an instruction from the user to perform cleaning after the first cleaning has ended, the determining section 11 determines whether or not the prescribed period has elapsed between the end of the first cleaning and the performance of the second cleaning.

The determining section 11 determines whether or not an ejection amount of ink is a prescribed ejection amount. Specifically, the determining section 11 determines whether or not a first ejection amount is a prescribed ejection amount. The prescribed ejection amount is "6 mL", for example. The first ejection amount is an amount of ink ejected during the first cleaning.

The determining section 11 determines whether or not non-ejecting nozzles 77 have decreased. Specifically, the determining section 11 determines whether or not non-ejecting nozzles 77 have decreased based on a check pattern CP.

The adjusting section 12 adjusts the ejection amount of ink in a stepwise manner based on the determination result by the determining section 11. As a result, an amount of ink which can resolve non-ejecting nozzles can be ejected.

Also, the adjusting section 12 adjusts the amount of ink ejected during the second cleaning from the first ejection amount to a second ejection amount based on the determination result by the determining section 11. Specifically, when the prescribed period has not elapsed between the end of the first cleaning and the performance of the second cleaning, the adjusting section 12 adjusts the amount of ink ejected during the second cleaning from the first ejection amount to the second ejection amount. The first ejection amount is an amount of ink ejected during the first cleaning. The second ejection amount is an ejection amount of ink that has been adjusted by the adjusting section 12. The second ejection amount is an amount of ink ejected during the second cleaning. The second ejection amount is greater than the first ejection amount. When the prescribed period has not elapsed between the end of the first cleaning and the performance of the second cleaning, a number of non-ejecting nozzles 77 are not resolved. Accordingly, the ejection amount of ink is adjusted. As a result, an amount of ink which can resolve non-ejecting nozzles can be ejected.

Also, when the prescribed period has elapsed between the end of the first cleaning and the start of the second cleaning, the adjusting section 12 keeps the amount of ink ejected during the second cleaning at the first ejection amount. When the prescribed period elapses, any non-ejecting nozzles are resolved. Accordingly, the ejection amount of ink is not adjusted and remains at the first ejection amount. As a result, the condition of the nozzles 77 can be determined and the amount of ink can be adjusted based on the period.

Also, the adjusting section 12 adjusts the number of times ink is ejected during the second cleaning based on the determination result by the determining section 11. Specifically, the adjusting section 12 adjusts the number of times ink is ejected during the second cleaning when the determining section 11 determines that the ejection amount of ink is the prescribed ejection amount. As a result, the number of times ink is ejected can be adjusted and non-ejecting nozzles can be prevented.

Next, a process of determining whether or not ink has been ejected from the nozzles 77 is described with reference to FIGS. 4 to 5B.

Figure 5A:
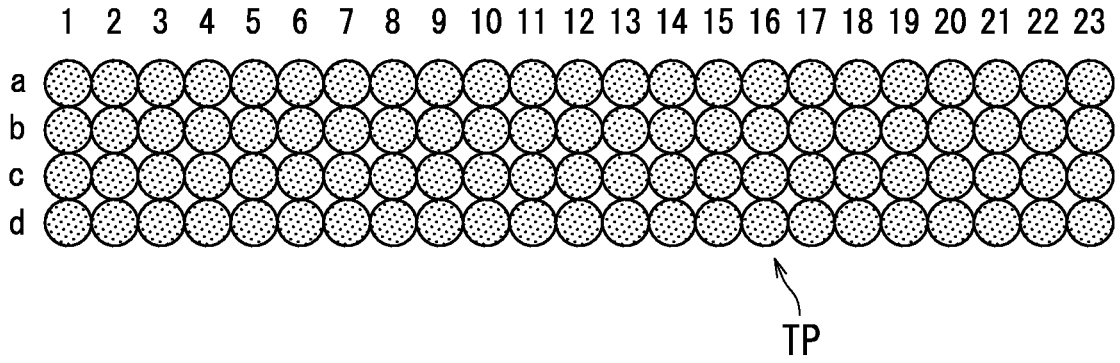
FIG. 5A is a diagram illustrating a test pattern.

FIG. 5A is a diagram illustrating a test pattern TP. The test pattern TP is represented by image data of an image formed when ink is ejected from each nozzle 77 in a state where congealed ink is not clogging any nozzles 77. The test pattern TP is stored in the storage 9.

Twenty three droplet attachment positions are exhibited in the long direction of the test pattern TP. Four droplet attachment positions are exhibited in the short direction of the test pattern TP. A line a, a line b, a line c, and a line d are included in a width of the test pattern TP in the short direction. Each of the lines a to d include data indicating droplet attachment positions 1 to 23.

Figure 5B:
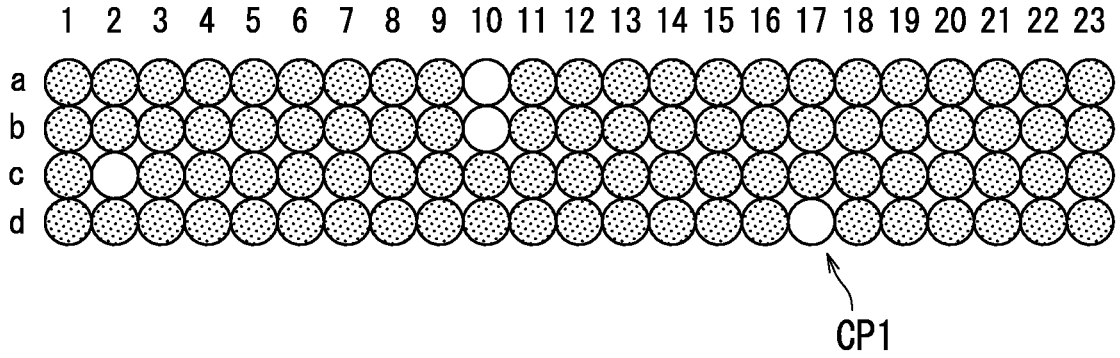
FIG. 5B is a diagram illustrating a first check pattern.

FIG. 5B is a diagram illustrating a first check pattern CP1. The first check pattern CP1 is represented by image data in which the reading section 3 has scanned an image formed after the first cleaning. The first check pattern CP1 is represented by image data in which the reading section 3 has scanned an image formed in a case where the image forming section 7 has been controlled so as to eject ink from each of the nozzles 77. In the first cleaning, cleaning of the nozzles 77 is performed with the first ejection amount.

Twenty three droplet attachment positions are exhibited in the long direction of the first check pattern CP1. Four droplet attachment positions are exhibited in the short direction of the first check pattern CP1. A line a, a line b, a line c, and a line d are included in a width of the first check pattern CP1 in the short direction. Each of the lines a to d include data indicating droplet attachment positions 1 to 23.

As illustrated in FIG. 5B, the tenth droplet attachment position in line a, the tenth droplet attachment position in line b, the second droplet attachment position in line c, and the seventeenth droplet attachment position in line d are droplet attachment positions in which ink has not been ejected.

When determining whether or not ink has been ejected from the nozzles 77, the controller 10 controls the image forming section 7 such that the image forming section 7 ejects ink from the nozzles 77 to form an image on the recording medium P based on image data. Next, the reading section 3 reads the image formed on the recording medium P. The image data acquired by the reading section 3 is the check pattern CP.

The determining section 11 determines whether or not the test pattern TP matches the check pattern CP based on the test pattern TP illustrated in FIG. 5A and the check pattern CP illustrated in FIG. 5B. When the test pattern TP matches the check pattern CP, the determining section 11 determines that ink has been ejected from the nozzles 77. When the test pattern TP does not match the check pattern CP, the determining section 11 determines that ink has not been ejected from the nozzles 77.

For example, the determining section 11 determines whether or not data indicating the first droplet attachment position of line a in the test pattern TP illustrated in FIG. 5A matches data indicating the first droplet attachment position of line a in the first check pattern CP1 illustrated in FIG. 5B. As illustrated in FIG. 5B, ink is ejected to the first droplet attachment position in line a. Therefore, the determining section 11 determines that the data indicating the first droplet attachment position of line a in the test pattern TP matches the data indicating the first droplet attachment position of line a in the first check pattern CP1. As a result, the determining section 11 determines that ink has been ejected from the nozzle 77 corresponding to the first droplet attachment position of line a.

For example, when the determining section 11 determines whether or not ink has been ejected from the nozzle 77 corresponding to the second droplet attachment position of line c, the determining section 11 determines whether or not data indicating the second droplet attachment position of line c in the test pattern TP matches data indicating the second droplet attachment position of line c in the first check pattern CP1. As illustrated in FIG. 5B, ink has not been ejected to the second droplet attachment position of line c. Therefore, the determining section 11 determines that the data indicating the second droplet attachment position of line c in the test pattern TP does not match the data indicating the second droplet attachment position of line c in the first check pattern CP1. As a result, the determining section 11 determines that ink has not been ejected from the nozzle 77 corresponding to the second droplet attachment position of line c.

By determining whether or not the test pattern TP matches the check pattern CP, the determining section 11 can determine whether or not ink has been ejected from the nozzles 77. As a result, the determining section 11 can determine whether or not any of the nozzles 77 are non-ejecting.

The determination result by the determining section 11 is stored in the storage 9. The number of non-ejecting nozzles 77 is included in the determination result. Note that the information section 21 may communicate the determination result by the determining section 11 to the user. For example, when ink has been ejected from the nozzles 77, the information section 21 communicates the determination result to the user. Also, when ink has not been ejected from the nozzles 77, the information section 21 communicates the determination result to the user. Note that when ink has not been ejected from the nozzles 77, the information section 21 may communicate that replacement of the image forming section 7 is necessary.

Figure 5C:
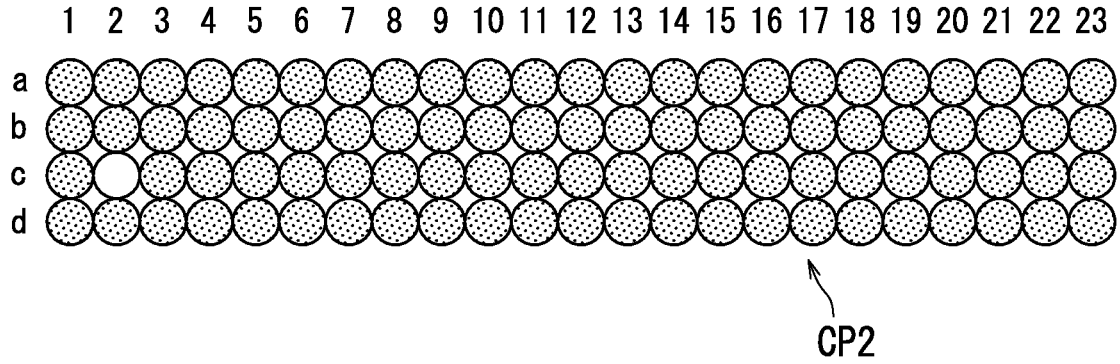
FIG. 5C is a diagram illustrating a second check pattern.

Next, a process of determining whether or not non-ejecting nozzles 77 have decreased is described with reference to FIGS. 4 to 5C. FIG. 5C is a diagram illustrating a second check pattern CP2. The second check pattern CP2 is represented by image data of an image formed after the second cleaning. The second cleaning is cleaning executed after the first cleaning.

Twenty three droplet attachment positions are exhibited in the long direction of the second check pattern CP2. Four droplet attachment positions are exhibited in the short direction of the second check pattern CP2. A line a, a line b, a line c, and a line d are included in a width of the second check pattern CP2 in the short direction. Each of the lines a to d includes data indicating droplet attachment positions 1 to 23.

As illustrated in FIG. 5C, the second droplet attachment position of line c in the second check pattern CP2 is a droplet attachment position in which ink has not been ejected.

When determining whether or not non-ejecting nozzles 77 have decreased, the determining section 11 determines whether or not the test pattern TP matches the second check pattern CP2 based on the test pattern TP illustrated in FIG. 5A and the second check pattern CP2 illustrated in FIG. 5C.

By determining whether or not the test pattern TP matches the second check pattern CP2, the determining section 11 determines whether or not ink has been ejected from the nozzles 77. As a result, the determining section 11 can determine whether or not the nozzles 77 are non-ejecting.

The determination result by the determining section 11 is stored in the storage 9. The number of non-ejecting nozzles 77 is included in the determination result.

Next, the controller 10 acquires the number of non-ejecting nozzles 77 from the storage 9. The number of non-ejecting nozzles 77 includes the number of non-ejecting nozzles 77 after the first cleaning and the number of non-ejecting nozzles 77 after the second cleaning. The determining section 11 determines whether or not the non-ejecting nozzles 77 have decreased based on the number of non-ejecting nozzles 77 after the first cleaning and the number of non-ejecting nozzles 77 after the second cleaning.

For example, as illustrated in FIG. 5B, four non-ejecting nozzles 77 are exhibited in the first check pattern CP1. As illustrated in FIG. 5C, one non-ejecting nozzle 77 is exhibited in the second check pattern CP2. As a result, the determining section 11 determines that non-ejecting nozzles 77 have decreased. Because whether or not non-ejecting nozzles 77 have decreased can be determined after the second cleaning, change to the nozzles 77 due to performance of the second cleaning can be determined. Because change to the nozzles 77 can be determined, the determining section 11 can determine the effect of the second cleaning.

Next, a table T exhibiting ejection amount data of ink stored in the storage 9 is described with reference to FIG. 6. FIG. 6 illustrates the ejection amount data of ink ejected by cleaning. As illustrated in FIG. 6, the amount of ink ejected by cleaning indicates any of a first level ejection amount of ink, a second level ejection amount of ink, a third level ejection amount of ink, a fourth level ejection amount of ink, and a fifth level ejection amount of ink. The first level ejection amount of ink is "0 mL". The second level ejection amount of ink is "1 mL". The third level ejection amount of ink is "2 mL". The fourth level ejection amount of ink is "6 mL". The fifth level ejection amount of ink is "6 mL". When the ejection amount of ink is at the first to fourth levels, the number of times of ejection is "once". When the ejection amount of ink is at the fifth level, the number of times of ejection is "twice".

Figure 7:
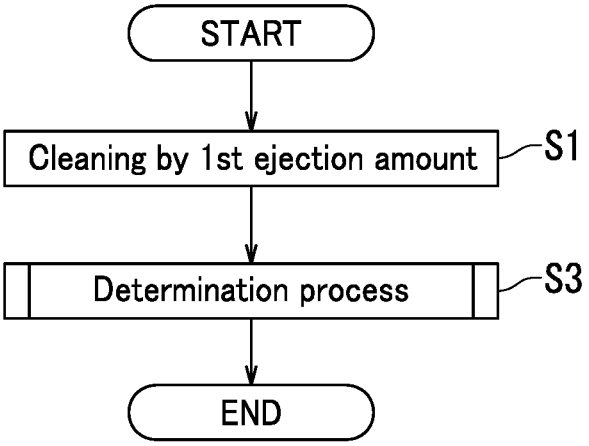
FIG. 7 is a flowchart depicting a cleaning process.

Next, a cleaning process is described with reference to FIGS. 7 to 9. FIG. 7 is a flowchart depicting the cleaning process. As depicted in FIG. 7, the cleaning process includes Steps S1 and S3.

When performing the cleaning process, the user can select either the first level ejection amount or the third level ejection amount as the amount of ink ejected during cleaning.

In Step S1, the controller 10 performs cleaning. Specifically, the controller 10 controls the image forming section 7 such that the image forming section 7 ejects ink of an ejection amount selected by the user. The ejection amount of ink selected by the user is the first ejection amount, for example. The process advances to Step S3.

In Step S3, the determining section 11 performs a determination process. The determination process is described later with reference to FIG. 9. The process ends.

Next, a second cleaning process is described with reference to FIG. 8. FIG. 8 is a flowchart depicting the second cleaning process. As depicted in FIG. 8, the second cleaning process includes Steps S5 to S27. The second cleaning process is performed when the operation panel 2 receives an instruction to perform additional cleaning from the user after previous cleaning.

In Step S5, the controller 10 acquires previous cleaning information from the storage 9. The previous cleaning is equivalent to an example of "first cleaning". The process advances to Step S7.

In Step S7, the determining section 11 determines whether or not the prescribed period has elapsed between the end of the previous cleaning and the performance of the current cleaning. The current cleaning is equivalent to an example of the "second cleaning". When the prescribed period has elapsed (Yes in Step S7), the process advances to Step S17. When the prescribed period has not elapsed (No in Step S7), the process advances to Step S9.

When a negative determination is made in Step S7, the determining section 11 determines whether or not the amount of ink ejected during the previous cleaning is a prescribed ejection amount in Step S9. The amount of ink ejected during the previous cleaning is equivalent to an example of the "first ejection amount". When the first ejection amount is the prescribed ejection amount (Yes in Step S9), the process advances to Step S19. When the first ejection amount is not the prescribed ejection amount (No in Step S9), the process advances to Step S11.

When a negative determination is made in Step S9, the adjusting section 12 adjusts the amount of ink ejected during the current cleaning from the first ejection amount to the second ejection amount in Step S11 based on the determination result by the determining section 11. The process advances to Step S13.

In Step S13, the controller 10 controls the image forming section 7 such that the image forming section 7 performs cleaning by ejecting ink of the second ejection amount. The process advances to Step S15.

In Step S15, the determining section 11 performs the determination process. The determination process is described later with reference to FIG. 9. The process ends.

When an affirmative determination is made in Step S7, the controller 10 controls the image forming section 7 such that the image forming section 7 performs cleaning by ejecting ink of the first ejection amount in Step S17. The process ends.

When an affirmative determination is made in Step S9, the determining section 11 determines whether or not the number of non-ejecting nozzles 77 has decreased in Step S19. When the number of non-ejecting nozzles 77 has not decreased (No in Step S19), the process advances to Step S27. When the number of non-ejecting nozzles 77 has decreased (Yes in Step S19), the process advances to Step S21.

In Step S21, the adjusting section 12 adjusts the number of times ink is ejected during the current cleaning based on the determination result by the determining section 11. The process advances to Step S23.

In Step S23, the controller 10 controls the image forming section 7 such that the image forming section 7 performs cleaning by ejecting ink according to the number of times, adjusted by the adjusting section 12, ink is ejected. The process advances to Step S25.

In Step S25, the determining section 11 performs the determination process. The process ends.

When a negative determination is made in Step S19, the controller 10 controls the information section 21 such that the information section 21 communicates the determination result by the determining section 11 in Step S27. The process ends.

Next, the determination process performed by the controller 10 is described with reference to FIG. 9. FIG. 9 is a flowchart depicting the determination process. The determination process depicted in FIG. 9 corresponds to Step S3 depicted in FIG. 7 and Steps S15 and S25 depicted in FIG. 8. The determination process includes Steps S101 to S107.

In Step S101, the controller 10 controls the image forming section 7 such that the image forming section 7 forms an image exhibiting the check pattern CP on the recording medium P by ejecting ink from the nozzles 77.

In Step S103, the controller 10 controls the reading section 3 such that the reading section 3 reads the image exhibiting the check pattern CP formed on the recording medium P.

In Step S105, the determining section 11 determines whether or not there is a change to any non-ejecting nozzles 77. Specifically, the determining section 11 determines whether or not the test pattern TP matches the check pattern CP based on the test pattern TP and the check pattern CP. When the test pattern TP matches the check pattern CP (Yes in Step S105), the process advances to Step S19. When the test pattern TP does not match the check pattern CP (No in Step S105), the process advances to Step S107.

When a negative determination is made in Step S105, the controller 10 controls the storage 9 such that the storage 9 stores therein the positions and number of non-ejecting nozzles 77 in Step S107. The process returns to the flowchart depicted in FIG. 8

In the above description with reference to FIGS. 6 to 9, when adjusting the ejection amount of ink in a stepwise manner, the adjusting section 12 adjusts the amount of ink ejected during the second cleaning performed after the first cleaning from the first ejection amount to the second ejection amount.

For example, when ink is ejected at the first level in the first cleaning, the adjusting section 12 adjusts the amount of ink ejected during the second cleaning from the first level ejection amount to the second level ejection amount.

Specifically, when a cleaning instruction is received from the user after the first cleaning, the controller 10 acquires cleaning information from the storage 9 (Step S5). Next, the determining section 11 determines whether or not a prescribed period has elapsed between the end of the first cleaning and the performance of the second cleaning (Step S7).

When the prescribed period has elapsed, the amount of ink ejected during the second cleaning becomes the first level ejection amount of ink (Step S17).

When the prescribed period has not elapsed, the adjusting section 12 adjusts the amount of ink ejected during the second cleaning from the first ejection amount to the second ejection amount (Step S11). For example, as illustrated in FIG. 6, the amount of ink ejected during the second cleaning goes from the first level ejection amount of ink to the second level ejection amount of ink. Specifically, the adjusting section 12 adjusts the amount of ink ejected during the second cleaning from "0 mL" to "1 mL".

Because the adjusting section 12 can adjust the amount of ink ejected during the second cleaning from the first ejection amount to the second ejection amount, the possibility of non-ejecting nozzles 77 being resolved improves.

After performance of the second cleaning, the determining section 11 determines whether or not ink has been ejected from the nozzles 77 (Step S15). As a result, the determining section 11 can determine whether or not any of the nozzles 77 are non-ejecting. Also, the determining section 11 can determine whether or not non-ejecting nozzles 77 have been resolved by the second level ejection amount of ink. The determination result is stored in the storage 9.

The determination result by the determining section 11 is communicated to the user from the information section 21

(Step S25). As a result, the user can be notified of the determination result by the determining section 11.

When the second level ejection amount of ink is ejected in the first cleaning, the adjusting section 12 adjusts the amount of ink ejected during the second cleaning from the second level ejection amount to the third level ejection amount. Specifically, the adjusting section 12 adjusts the amount of ink ejected during the second cleaning from "1 mL" to "2 mL".

After the performance of the second cleaning, the determining section 11 determines whether or not ink has been ejected from the nozzles 77. As a result, the determining section 11 can determine whether or not any of the nozzles 77 are non-ejecting. Also, the determining section 11 can determine whether or not non-ejecting nozzles 77 have been resolved by the third level ejection amount of ink. The determination result is stored in the storage 9.

When ink has been ejected at the third level in the first cleaning, the adjusting section 12 adjusts the amount of ink ejected during the second cleaning from the third level ejection amount to the fourth level ejection amount. Specifically, the adjusting section 12 adjusts the amount of ink ejected during the second cleaning from "2 mL" to "6 mL".

After the performance of the second cleaning, the determining section 11 determines whether or not ink has been ejected from the nozzles 77. As a result, the determining section 11 can determine whether or not the nozzles 77 are non-ejecting. Also, the determining section 11 can determine whether or not non-ejecting nozzles 77 have been resolved by the fourth level ejection amount of ink. The determination result is stored in the storage 9.

Because the adjusting section 12 adjusts the amount of ink ejected during the second cleaning in a stepwise manner, the ejection amount of ink can be adjusted in a stepwise manner until reaching an ejection amount capable of resolving non-ejecting nozzles 77. As a result, the possibility of non-ejecting nozzles 77 being resolved improves.

Note that although an example has been described in which the user instructs performance of subsequent cleaning each time cleaning ends, the controller 10 may perform the second cleaning based on the determination result of the determination process. In this case, the adjusting section 12 adjusts the amount of ink ejected during the second cleaning in a stepwise manner until reaching an ejection amount capable of resolving non-ejecting nozzles 77. Accordingly, the user need not instruct performance of cleaning each time cleaning ends. As a result, convenience for the user is improved.

Figure 8:
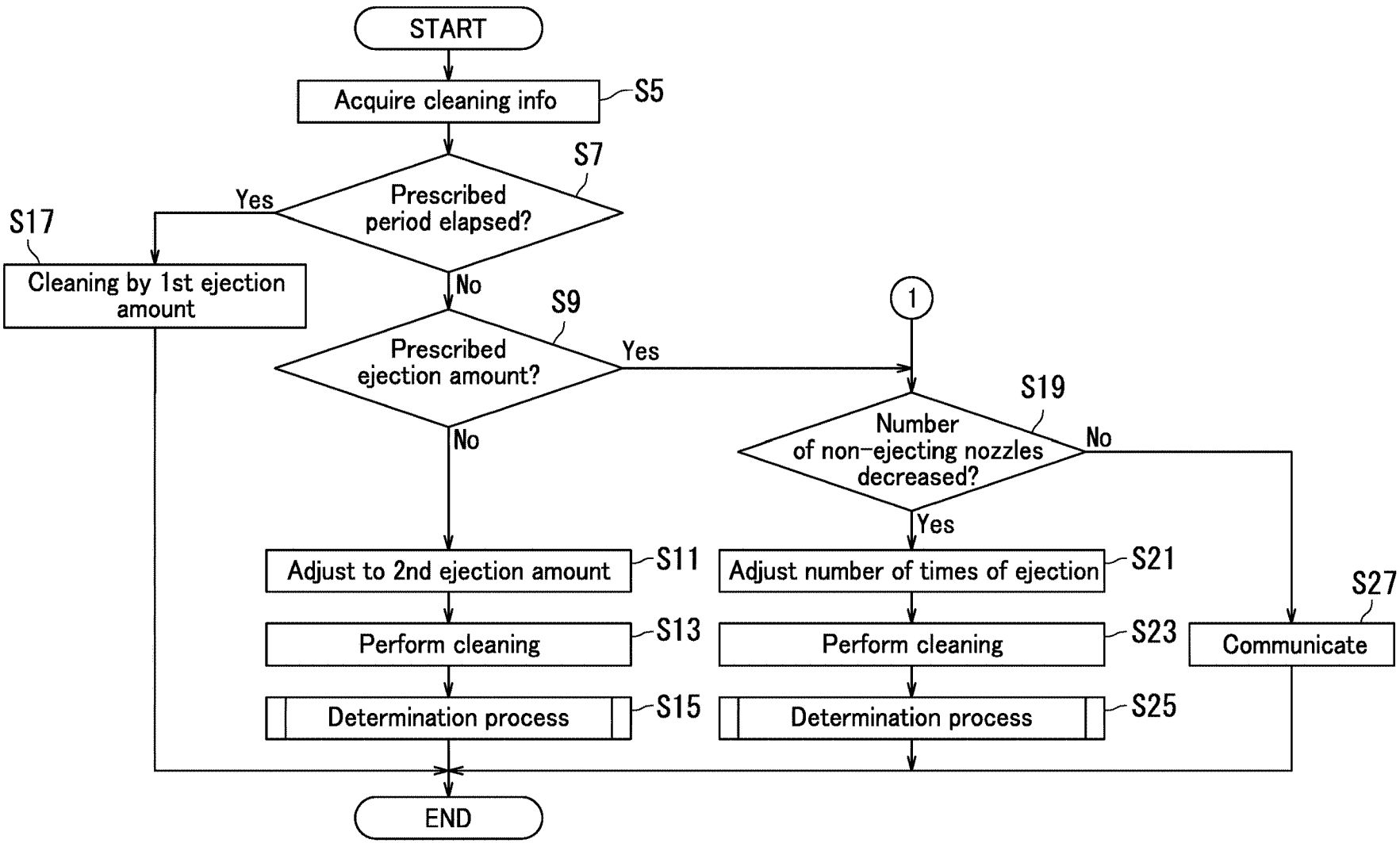
FIG. 8 is a flowchart depicting a second cleaning process.
Figure 9:
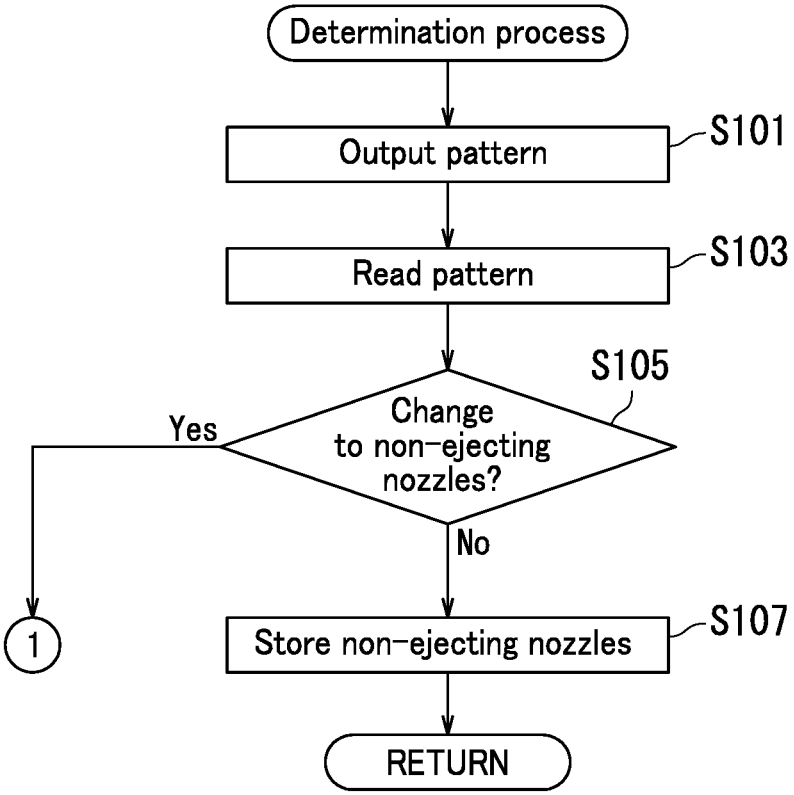
FIG. 9 is a flowchart depicting a determination process.

As illustrated in FIGS. 6 and 8, when the determining section 11 has determined that the amount of ink ejected during the first cleaning is the fourth level ejection amount of ink before performance of the second cleaning (Step S9), the adjusting section 12 adjusts the number of times ink is ejected during the second cleaning.

Specifically, when a cleaning instruction is received from the user after the first cleaning, the controller 10 acquires cleaning information from the storage 9 (Step S5). The determining section 11 determines whether or not the ejection amount of ink is a prescribed ejection amount (Step S9).

When the ejection amount of ink is the prescribed ejection amount, the determining section 11 determines whether or not the number of non-ejecting nozzles 77 has decreased (Step S19). When the determining section 11 determines that non-ejecting nozzles 77 have decreased, the adjusting section 12 adjusts the number of times ink is ejected during the second cleaning (Step S21). For example, as illustrated in FIG. 6, the adjusting section 12 adjusts the number of times ink is ejected during the second cleaning to twice. Accordingly, "6 mL" of ink is ejected twice. As a result, the possibility of non-ejecting nozzles 77 being resolved increases.

When the amount of ink ejected during the first cleaning is the fourth level ejection amount of ink, the determining section 11 may determine whether or not the user instructing cleaning is a service person.

An embodiment of the present disclosure is described so far with reference to the accompanying drawings. However, the present disclosure is not limited to the above embodiment and may be implemented in various manners within a scope not departing from the gist of the present disclosure. Furthermore, various disclosures may be formed by appropriately combining elements of configuration disclosed in the above embodiment. For example, some of the elements of configuration disclosed in the embodiment may be removed. In addition, elements of configuration from different embodiments may be appropriately combined. The drawings schematically illustrate main elements of configuration to facilitate understanding thereof. Aspects of the elements of configuration illustrated in the drawings, such as thickness, length, number and interval, may differ in practice for the sake of convenience for drawing preparation. Furthermore, aspects of the elements of configuration illustrated in the above embodiment, such as speed, material, shape, and dimension, are one example and are not particularly limited. The elements of configuration may be variously altered within a scope not substantially departing from the configuration of the present disclosure.

What is claimed is:

1. An inkjet recording apparatus which allows for cleaning, the inkjet recording apparatus comprising:

an image forming section which has a plurality of nozzles and is configured to form an image on a recording medium by ejecting ink from the nozzles; and a controller configured to control the image forming section, wherein the nozzles eject the ink during the cleaning, the controller includes:

a determining section configured to determine whether or not the ink has been ejected from the nozzles; and an adjusting section configured to adjust an ejection amount of the ink in a stepwise manner based on a determination result by the determining section, the cleaning includes first cleaning and second cleaning performed after the first cleaning, the determining section determines whether or not the ink has been ejected from the nozzles after the first cleaning, the adjusting section adjusts an amount of the ink ejected during the second cleaning from a first ejection amount to a second ejection amount based on the determination result by the determining section the first ejection amount is an amount of the ink ejected during the first cleaning, the second ejection amount is greater than the first ejection amount, when an instruction for the second cleaning is received after an end of the first cleaning and the second cleaning is performed, the determining section determines whether or not a prescribed period has elapsed between the end of the first cleaning and performance of the second cleaning, and when the prescribed period has not elapsed between the end of the first cleaning and the performance of the second cleaning, the adjusting section adjusts the amount of the ink ejected during the second cleaning from the first ejection amount to the second ejection amount.

2. The inkjet recording apparatus according to claim 1, wherein when the prescribed period has elapsed between the end of the first cleaning and the performance of the second cleaning, the adjusting section keeps the amount of the ink ejected during the second cleaning at the first ejection amount.

3. The inkjet recording apparatus according to claim 1, wherein the determining section determines whether or not the first ejection amount is a prescribed ejection amount, and the adjusting section adjusts the number of times the ink is ejected during the second cleaning based on the determination result by the determining section.

4. The inkjet recording apparatus according to claim 1, further comprising an information section configured to communicate the determination result by the determining section.

5. A cleaning method to be implemented by an inkjet recording apparatus, the cleaning method comprising:

forming an image on a recording medium by ejecting ink from a plurality of nozzles;

controlling ejection of the ink;

ejecting the ink from the nozzles during cleaning;

determining whether or not the ink has been ejected from the nozzles; and adjusting an ejection amount of the ink in a stepwise manner based on a determination result of whether or not the ink has been ejected, wherein the cleaning includes first cleaning and second cleaning performed after the first cleaning, in the determining, it is determined whether or not the ink has been ejected from the nozzles after the first cleaning, in the adjusting, an amount of the ink ejected during the second cleaning is adjusted from a first ejection amount to a second ejection amount based on the determination result by the determining, the first ejection amount is an amount of the ink ejected during the first cleaning, the second ejection amount is greater than the first ejection amount, when an instruction for the second cleaning is received after an end of the first cleaning and the second cleaning is performed, it is determined whether or not a prescribed period has elapsed between the end of the first cleaning and performance of the second cleaning, and when the prescribed period has not elapsed between the end of the first cleaning and the performance of the second cleaning, the amount of the ink ejected during the second cleaning is adjusted from the first ejection amount to the second ejection amount.

* * * * *